United States Patent [19]

Blaude et al.

[11] 3,971,667

[45] July 27, 1976

[54] INSTALLATION FOR TREATING SUGAR-MILL MOLASSES

[75] Inventors: Joseph Emile Albert Blaude; Georges Francois Michel Frederic Duchateau, both of Tienen, Belgium

[73] Assignee: Raffinerie Tirlemontoise, Brussels, Belgium

[22] Filed: Mar. 21, 1975

[21] Appl. No.: 560,444

[30] Foreign Application Priority Data

Mar. 25, 1974 Belgium ..... 812775

[52] U.S. Cl. ..... 127/9; 127/46 R; 127/47; 165/97

[51] Int. Cl.[2] ..... C13J 1/04

[58] Field of Search ..... 127/9, 46 R, 47, 53; 165/97

[56] References Cited

UNITED STATES PATENTS

| | | | |
|---|---|---|---|
| 2,490,759 | 12/1949 | Tyden | 165/97 X |
| 2,508,119 | 5/1950 | Lockman | 165/97 X |
| 2,919,114 | 12/1959 | Ljungstrom | 165/97 X |
| 3,251,408 | 5/1966 | Watson | 165/97 X |
| 3,593,779 | 7/1971 | Tokumitsu | 165/97 X |
| 3,627,014 | 12/1971 | Akashi | 165/97 X |

*Primary Examiner*—Morris O. Wolk
*Assistant Examiner*—Sidney Marantz
*Attorney, Agent, or Firm*—Sughrue, Rothwell, Mion, Zinn & Macpeak

[57] ABSTRACT

An apparatus for reacting diluted molasses with lime in a tank 5 includes a pair of heat exchangers 12, 17, a pair of four-way valves 10, 14, an inlet circuit 2, 15 for the tank, and a circuit 8, 19 for recirculating part of the reacted molasses back through the tank. The positions of the valves are periodically switched which reverses both the circuit couplings of and the directions of flow through the heat exchangers, to thereby dissolve any built up deposits and crusts in the heat exchangers.

3 Claims, 3 Drawing Figures

INSTALLATION FOR TREATING SUGAR-MILL MOLASSES

BACKGROUND OF THE INVENTION

This invention relates to an installation for treating sugar-mill molasses, which comprises a tank for reacting diluted molasses with lime, a first heat exchanger for cooling the diluted molasses which is arranged in the inlet circuit in the reaction tank and a second heat exchanger which is arranged in a circuit for recirculating in the diluted molasses, part of the treated molasses to cool said treated molasses.

SUMMARY OF THE INVENTION

The invention features the removal of those deposits or crusts which form on the surfaces of the heat exchanger located in the recirculating circuit for the treated molasses. Said deposits are comprised for the most part of an insoluble saccharose-lime combination and of lime. The cleaning of the encrusted surfaces of such heat exchangers is performed presently either by hand, or by means of an acid solution. This has the drawback of requiring the disconnection of the encrusted apparatus and the stoppage of the complete installation or the arrangement of a substitute heat exchanger.

This invention thus allows cleaning heat exchangers which are located in the circuits for recirculating the treated molasses without requiring the stoppage of the installations and without havng to provide an additional apparatus.

For this purpose according to the invention, the installation comprises devices for periodically switching over the heat exchangers. It has indeed been noticed that the saccharose contained in the diluted molasses reacts with the insoluble saccharose-lime combination and with the lime to form soluble saccharose-lime combinations.

The switching-over of the heat exchangers results in the diluted molasses being periodically cooled before entering the reaction tank, in that heat exchanger which has previously been used to cool the treated molasses. As the diluted molasses used to clean the heat exchanger will be treated thereafter with lime in the reaction tanks, the presence of saccharose-lime combinations in said diluted molasses is no drawback.

BRIEF DESCRIPTION OF THE DRAWINGS

Other details and features of the invention will stand out from the description given below by way of non limitative example and with reference to the accompanying drawings, in which.

DESCRIPTION OF THE PREFERRED EMBODIMENT

Figure 1:
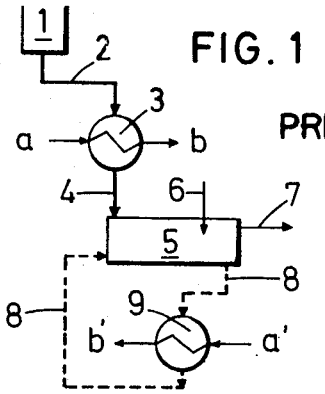
FIG. 1 PRIOR ART
FIG. 1 is a diagrammatic showing of a conventional installation for the continuous cold precipitation of saccharose from diluted sugar-mill molasses.

In the various figures, the same reference numerals pertain to similar elements.

In the three figures, the path followed by the diluted molasses has been shown wth solid lines, while the path followed by the treated molasses has been shown with dot-and-dash lines.

The installaton shown in FIG. 1 comprises a diluted molasses tank 1 which is connected through a line 2 to a heat exchanger 3 which is connected in turn through a line 4 to a reaction tank 5 to which is continuously added quicklime at 6. From the reaction tank 5, the treated molasses is discharged at 7 but part of the treated molasses is recycled through a circuit 8 and a heat exchanger 9 in the upstream portion of reaction tank 5 where it is mixed with the diluted molasses entering said tank through line 4.

Through heat exchangers 3 and 9 flows a cooling fluid the flow of which is shown diagrammatically by arrows *a,b* for heat exchanger 3 and by arrows *a',b'* for heat exchanger 9.

In said known installation, part of the insoluble saccharose-lime combination and the lime which has not reacted, in suspension in the treated molasses recycled through the circuit, settles on the surfaces of heat exchanger 9 which progressively clogs. When said exchanger 9 is clogged, the installation is stopped and the exchanger is disassembled to be scrubbed clean by hand.

Figure 2:
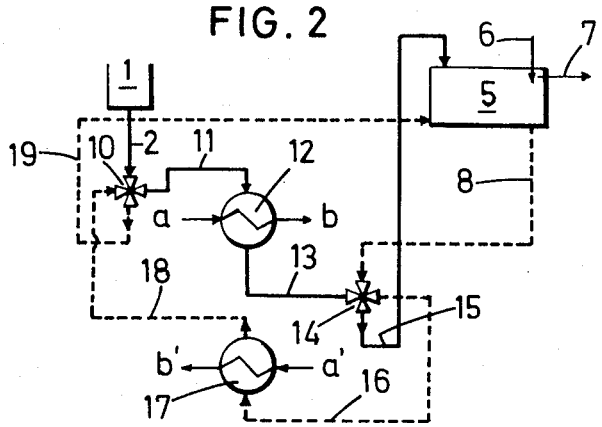
FIGS. 2 and 3 are diagrams of an installation for the continuous cold precipitation of saccharose from diluted sugar-mill molasses according to the invention, the figures showing two different operating steps.
Figure 3:
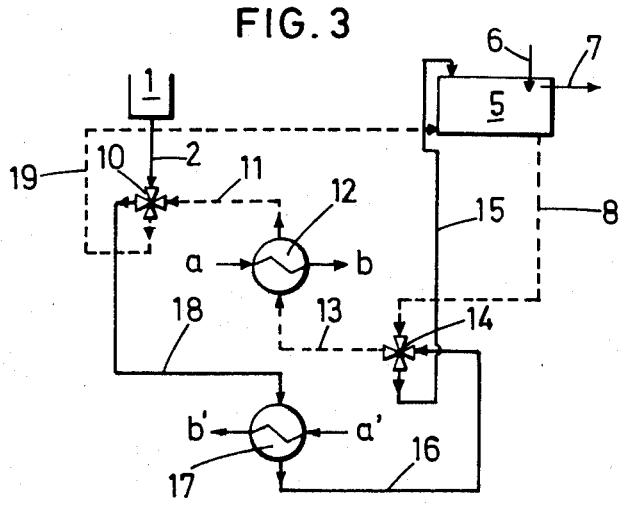

In the installation according to the invention, as shown in FIGS. 2 and 3, the heat exchangers shown at 12 and 17 respectively, are arranged in two parallel circuits 11,13 and 18,16 which are connected to two four-way valves 10,14. Valve 10 is moreover connected through line 2 to the diluted molasses tank 1 on the one hand and through a line 19 to the inlet of the reaction tank 5 for the treated molasses which is recycled after passing through a heat exchanger, on the other hand. Valve 14 is connected through a line 15 to the inlet of reaction tank 5 for the diluted molasses after the passage thereof through a heat exchanger on the one hand, and through a line 8 to the outlet from reaction tank 5 for that treated molasses part to be recycled on the other hand.

The installation according to the invention operates as follows: in a first step (FIG. 2), the diluted molasses is fed through line 2, four-way valve 10 and line 11, to the heat exchanger 12. The cooled diluted molasses is passed through line 13, four-way valve 14 and line 15, to reactor 5. During this same step, the treated molasses is recycled into reactor 5 through the recirculating line 8, four-way valve 14, line 16, heat exchanger 17, line 18, four-way valve 10 and line 19.

When the exchanger 17 is clogged, the four-way valves 10 and 14 are so operated as to obtain the liquid flow shown in FIG. 3, in which the diluted molasses flowing to the reaction tank passses through heat exchanger 17 in the oposite direction relative to the flow directon of the treated molasses during the preceding step. The reversal of the liquid flow direction is also performed for the heat exchanger 12. As shown in FIG. 3, the diluted molasses follows the following path: line 2, four-way valve 10, line 18, heat exchanger 17, line 16, four-way valve 14, line 15. The treated molasses is recycled along the following path: line 8, four-way valve 14, line 13, heat exchanger 12, line 11, four-way valve 10, line 19. The saccharose contained in the treated molasses dissolves the deposits and crusts formed in heat exchanger 17 during the passage of the diluted molasses and said exchanger is thus cleaned. When the heat exchanger 12 is clogged in turn, the four-way valves are again operated and the above-described cycle is started again.

It must be understood that the invention is in no way limited to the above embodiments and that many changes can be brought therein without departing from the scope of the invention as defined by the appended claims.

We claim:

1. An apparatus for treating sugar-mill molasses, comprising:

a. a source of diluted molasses, b. a tank for reacting the diluted molasses with lime, c. first and second heat exchangers, d. an inlet line for the tank, e. a circuit for recirculating part of the reacted molasses back through the tank, and f. valve means having a first position for coupling the source to the inlet line through the first heat exchanger in a first direction and for coupling the second heat exchanger in the recirculating circuit in a first direction, and having a second position for coupling the source to the inlet line through the second heat exchanger in a second direction opposite to the first direction and for coupling the first heat exchanger in the recirculating circuit in a second direction opposite to the first direction, whereby the periodic switching of the valve means serves to dissolve deposits and crusts that build up in the heat exchangers.

2. An apparatus as defined in claim 1 wherein the valve means comprises two four-way valves.

3. An apparatus as defined in claim 2 wherein the heat exchangers are each connected in different arms of a parallel circuit, and the ends of the arms are connected to different ports of the two valves.

* * * * *